United States Patent [19]

Petker et al.

[11] Patent Number: 4,751,784

[45] Date of Patent: Jun. 21, 1988

[54] DISPOSABLE SLIPPER AND METHOD FOR FORMING SAME

[76] Inventors: Al Petker, 244 N. Almont Dr., Beverly Hills, Calif. 90211; Erik Sundgaard, 1225 Woodhollow, Apt. 802, Houston, Tex. 77057

[21] Appl. No.: 72,110

[22] Filed: Jul. 10, 1987

[51] Int. Cl.[4] ..... A43B 3/10; A43B 3/12

[52] U.S. Cl. ..... 36/9 R; 36/11.5; 428/234

[58] Field of Search ..... 36/11.5, 9 R, 9 A, 7.3, 36/7.1 R; 428/234, 235, 300; 12/142 S

[56] References Cited

U.S. PATENT DOCUMENTS

| | | | |
|---|---|---|---|
| 2,747,301 | 5/1956 | Crane | 36/9 A |
| 3,603,006 | 9/1971 | Davenport | 36/11.5 |
| 3,800,446 | 4/1974 | Pass | 36/7.1 R |
| 3,874,100 | 4/1975 | Schwitters | 36/11.5 |
| 3,950,587 | 4/1976 | Colijn et al. | 428/234 |
| 4,217,704 | 8/1980 | Whitaker | 36/7.1 R |
| 4,469,740 | 9/1984 | Bailly | 428/234 X |

FOREIGN PATENT DOCUMENTS

| | | | |
|---|---|---|---|
| 2373243 | 7/1978 | France | 36/9 R |
| 2460116 | 1/1981 | France | 36/11.5 |
| 2461467 | 2/1981 | France | 36/11.5 |

*Primary Examiner*—James Kee Chi

*Attorney, Agent, or Firm*—Poms, Smith, Lande & Rose

[57] ABSTRACT

A disposable slipper and method for forming the same comprising a flat planar piece of a resilient foldable material shaped to conform to the outline of the foot of a human. A pair of strips extend outwardly from opposite sides of the slipper at the intersection of the sole and heel portion thereof. By folding one of the strips over on top of the other strip, the overlapping strip adheres to the material of the slipper thereby retaining the slipper to the foot of the user.

2 Claims, 1 Drawing Sheet

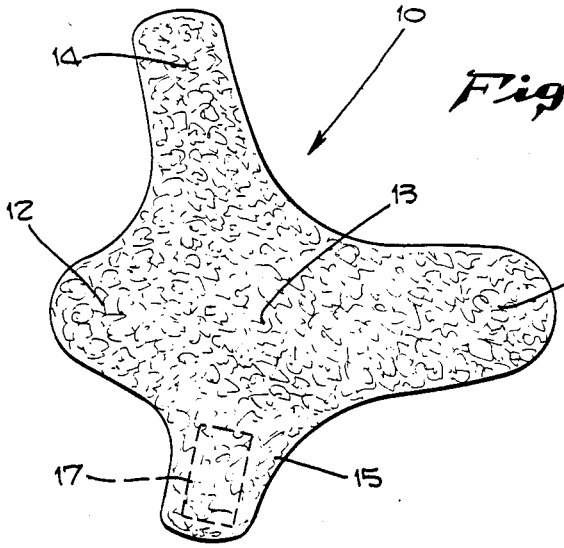
Fig. 1.
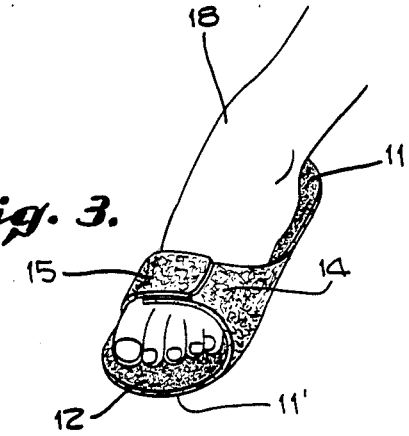
Fig. 3.
Fig. 2.
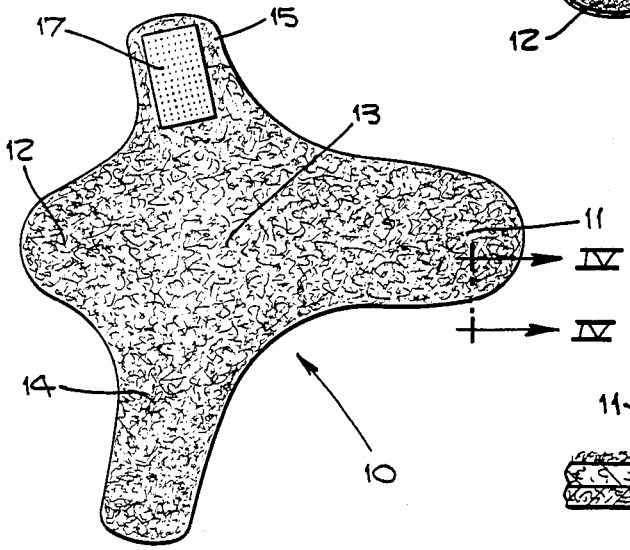
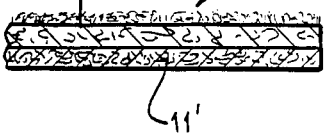
Fig. 4.

DISPOSABLE SLIPPER AND METHOD FOR FORMING SAME

BACKGROUND OF THE INVENTION

1. Field of the Invention

The invention relates to disposable footwear; and, more particularly, to a flexible disposable slipper.

2. Description of the Prior Art

Many different types of footwear, such as shoes and slippers, are known in the art. Generally, such footwear is relatively expensive but can be reused until it wears out. On some occasions, there is a need for a disposable inexpensive shoe or slipper. For example, when traveling light, it is difficult to pack slippers and the like. Alternatively, one may forget to pack the same and only discover the omission when at a hotel or the like. There is thus a need for a disposable inexpensive slipper that can be purchased at a hotel or the like. Also, in recent years, hotels and the like have made efforts to offer various amenities to their customers, such as disposable bathrobes. Disposal complimentary slippers could be another amenity offered by the hotel. This is particularly welcome in pool or shower areas where the establishment may be held liable for someone slipping on a wet surface. A non-skid disposable slipper might be particularly valuable around gyms, showers, tubs, pools, spas, health clubs, hospitals, etc., and in or out of the home. Such a slipper should be inexpensive, disposable, easy to put on and take off, preferably adaptable to feet of different sizes, be easily dried and cleaned, if desired. Also, such a disposable slipper should be inexpensive to manufacture and, thus, convenient to dispose of.

SUMMARY OF THE INVENTION

It is an object of this invention to provide an inexpensive and disposal slipper. It is a further object of this invention to provide a disposable slipper formed from a blank of resilient material. It is still further an object of this invention to provide a disposable slipper that is adaptable to feet of differing sizes.

It is still another object of this invention to provide a disposable slipper of anti-bacterial material which can be easily shaken or squeezed dry when wet.

It is another object of this invention to provide a method for forming a disposable slipper.

These and other objects are preferably accomplished by providing a disposable slipper comprising a flat planar piece of a resilient foldable material shaped to conform to the outline of the foot of a human. A pair of strips extend outwardly from opposite sides of the slipper at the intersection of the sole and heel portion thereof. By folding one of the strips over on top of the other strip, the overlapping strip may adhere to the overlapped strip or to the material of the slipper and retain the slipper to the foot of the user.

BRIEF DESCRIPTION OF THE DRAWING

FIG. 1 is a bottom plan view of a disposable slipper for the right foot in accordance with the teachings of the invention;

FIG. 2 is a top plan view of the slipper of FIG. 1; and

FIG. 3 is a perspective plan view of the slipper of FIGS. 1 and 2 mounted on the foot of a user; and FIG. 4 is a view taken along lines IV—IV of FIG. 1.

DESCRIPTION OF THE PREFERRED EMBODIMENT

Referring now to FIG. 1 of the drawing, a disposable slipper 10 is shown having an outline in the general shape of the undersurface of the foot of a human. Thus, slipper 10 includes a heel portion 11 integral with an instep portion 13 interconnecting heel portion 11 to a sole portion 12. A pair of elongated extension members 14, 15 extend from each side of the area of slipper 10 where the sole portion 12 meets the instep portion 13. These extension members 14, 15 are chosen of a length so that they can overlap and retain the slipper 10 to the foot of a wearer as will be discussed. Note that extension portion 14 is considerably longer than extension portion 15, as for example, 25% longer, and may be narrower at its point of connecting to the remainder of slipper 10 than extension member 15. Note also that the radius of curvative where extension portion 14 blends into the right side of the remainder of slipper 10 as shown in FIG. 2 may be longer than the radius of curvature where extension portion 15 blends into the remainder of slipper 10.

Preferably, the parts of the entire slipper 10, as heretofore discussed, are of a single piece of flexible material. Although any suitable material may be used, the material preferred is a polyester fiber material which is supplied in bales. The bales are picked apart and the fiber material is layered back and forth to form a webbing having a preferred density of about one ounce per square foot. A needle punch in the form of a board having a plurality of 4" long barbed needles spaced $\frac{1}{4}$" apart is used to punch through one side of the webbing and the barbs pull or bring the fibers in the material up and out of the webbing. The webbing is then mashed down to an overall thickness of about $\frac{1}{4}$" or less.

Any suitable acrylic resin material is now applied to the mashed-down webbing in any suitable manner, such as by foaming the same and spraying it in, and the resin-impregnated webbing is passed through an oven at a temperature of about 350° F.–400° F. for about 2 to 3 minutes. The heated blank of material is turned over, resin is again applied, then passed through the over for about 2 to 3 minutes at about 350° F.–400° F. The blank of material is again turned over and passed through the oven, without a resin treatment, again for about 2 to 3 minutes at 350° F.–400° F. The heated blank of material is now cooled. These final heat-treated resinated blanks of material can of course be of any suitable dimensions, such as 40" to 84" wide, and are now slit to the desired width.

The foregoing results in a blank of material having a relatively smooth fibrous side (FIG. 1) and a side with fibers sticking thereout (the side shown in FIG. 2—see also FIG. 4). The specific material disclosed herein is available from Western Synthetic Felt Co. under the trade name Westdeck. Of course, any suitable means known in the art may be used to form a polyester fibrous material that has been resinated. The preferred treatment described herein results in a blank of material, which can be of any desired length and width, preferably $\frac{1}{4}$" or so thick, and shipped in rolls. Such material has a rough side and a fibrous or smoother side as seen in FIG. 4.

The blank of material can be now precut to size, such as to the shape shown in FIGS. 1 and 2. These shapes may vary so as to accommodate the same feet of different sizes, such as small, medium and large. Alternatively, precut square of rectangular pieces of material may be provided to the consumer along with instructions for cutting the same or may be provided in a variety of sizes. The preferred material disclosed herein can be easily cut using conventional scissors. The customer merely places his bare foot on a blank of material, say 12"×12", draws an outline of his foot, and cuts out the outline leaving side tabs 14, 15. Precut pieces of Velcro strips may be provided, as will be discussed, either already secured to the precut blank or affixed by the customer thereto.

The drawings show a slipper for the left foot; a slipper for the right foot would be a mere mirror image of that show in the drawing. Thus as seen in FIG. 2, a Velcro strip 17 of a hook material is provided on extension member 15. When the user steps on the upper surface of the cut blank as seen in FIG. 2 (the surface visible in FIG. 2), then folds extension members 14, 15 one over the other over his or her foot 18 (FIG. 3), the Velcro strip 17 engages the material of the slipper 10 and holds the slipper 10 to foot 18 until released.

Alternatively, mating Velcro material, such as hook and loop strips, may be provided on the extension members 14 or 15 to engage with each other. Preferably, however, the preferred fibrous material of slipper 10 along is used which would result in securement. Of course, other releasable fastening means may be provided but the foregoing is an easily adjustable, releasable and inexpensive means of securement. One such preferred hook (and loop, if desired) fastener material is sold by 3M under the trademark Scotchmate mushroom fastener system. This material has a side which is secured to the material of slipper 10 by any known process, such as a hot melt wax process.

The softer side of slipper 10 provides a cushioning material for the foot and the rougher side 11' in FIGS. 1 and 4 wears better. The slipper 10 is slip proof and comprised of anti-bacterial fibers. It is of a non-medicated material, can be easily shaken or squeezed dry and returns to its original shape. It can be put in a washing machine and washed and dried but is so inexpensive that it can be discarded after use. The low cost enables the slipper to be used as a promotional or free item, such as a handout provided by a hotel, gym, pool, etc. Use around pools, hospitals, showers, tubs, baths, in or out of the home, reduces potential for slippage and prevents lawsuits. There has thus been disclosed an inexpensive disposal slip proof slipper which may be precut or cut to size. Although a particular embodiment of the invention has been disclosed, we do not intend to be bound thereby since variations may occur to an artisan and the invention should be limited only by the appended claims.

We claim:

1. A disposable slip proof slipper comprised of a single piece of flat planar fibrous material having a central portion in the outline of a human foot forming a sole and heel interconnected by an arch and flat extension members lying in the same plane as said central portion extending outwardly on both sides of said central portion at generally the intersection of said sole and arch, releasable securement means associated with said slipper and at least one of said extension members for releasing securing said slipper to the foot of a user, said releasable securement means including a strip of Velcro hook material secured to one of said extension members adapted to engage and releasably adhere to the fibrous material of the other of said extension members, said fibrous material being uniform throughout and of a resin-treated polyester material having a rough fibrous side and a softer fibrous side, the rough fiber side being comprised of matted down fibers and the softer fibrous side being comprised of a plurality of outwardly extending fibers, one of said extension members being substantially longer than the other of said extension members.

2. In the slipper of claim 1 wherein said slipper is about ¼" thick and said fibers have a density of about 1 ounce per square foot.

* * * * *